United States Patent [19]

Jones

[11] Patent Number: 4,888,893

[45] Date of Patent: Dec. 26, 1989

[54] STRANDED MOTORIST DISTRESS SIGN

[76] Inventor: Jacqueline Jones, 1309 Fair Pines Cove, Stone Mountain, Ga. 30083

[21] Appl. No.: 112,483

[22] Filed: Oct. 26, 1987

[51] Int. Cl.[4] ..... G09F 21/04

[52] U.S. Cl. ..... 40/592; 40/600

[58] Field of Search ..... 40/606, 592, 600, 609, 40/610, 591, 10 R, 908, 571, 124.1

[56] References Cited

U.S. PATENT DOCUMENTS

| | | | |
|---|---|---|---|
| 3,225,475 | 12/1965 | Shank | 40/592 |
| 3,422,556 | 1/1969 | Lyons et al. | 40/592 |
| 3,670,438 | 6/1972 | Carroll et al. | 40/591 |
| 3,736,682 | 6/1973 | Farmer et al. | 40/592 |
| 3,763,583 | 10/1973 | Gregg | 40/124.1 |
| 3,797,151 | 3/1974 | Dexter | 40/592 |
| 4,387,520 | 6/1983 | Ahrens | 40/606 |
| 4,587,755 | 5/1986 | Sunshine | 40/571 |

*Primary Examiner*—Gene Mancene
*Assistant Examiner*—Cary E. Stone
*Attorney, Agent, or Firm*—Thomas & Kennedy

[57] ABSTRACT

A stranded motorist distress sign assembly includes a thin substantially flat, semi-flexible base member having one or more bosses or protrusions extending from one surface thereof, and a thin, substantially flat, semi-flexible sign plate having letters forming a message embossed thereon. The sign plate is mounted and held on the base member by mating hook and loop strips of material mounted on the protrusions and on the back of the sign plate. The bottom of the base member has magnetic members mounted thereon for attaching the assembly to a vehicle body.

6 Claims, 1 Drawing Sheet

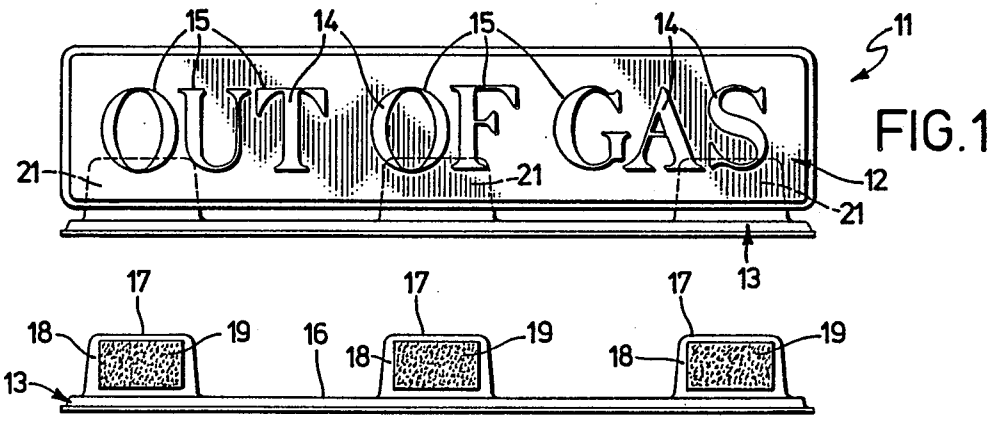
FIG. 1
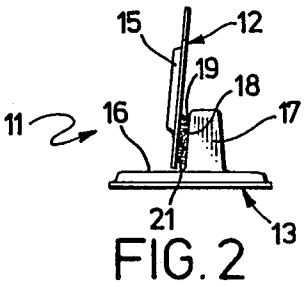
FIG. 2
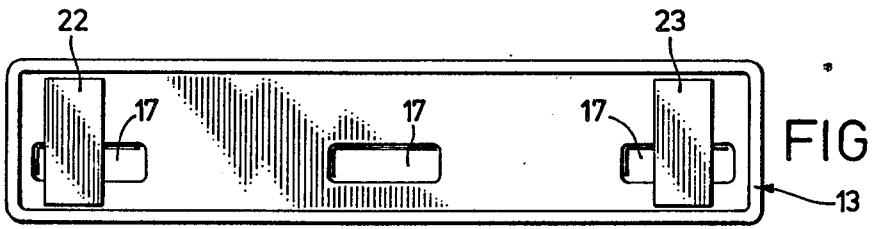
FIG. 3
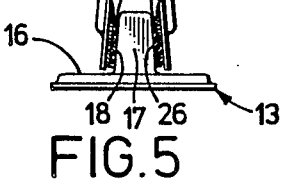
FIG. 4
FIG. 5
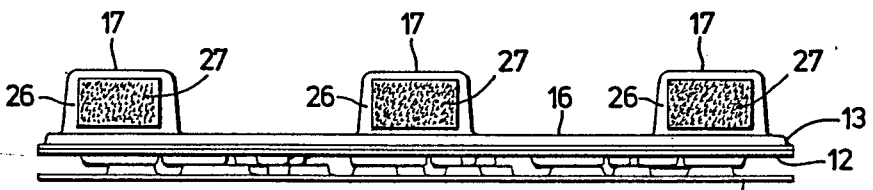
FIG. 6

STRANDED MOTORIST DISTRESS SIGN

BACKGROUND OF THE INVENTION

This invention relates to a distress sign for use by stranded motorists, and, more particularly, to such a sign assembly that may be easily stowed and carried in an automobile, and quickly assembled when the need arises.

Distress signs for use with automobiles and the like are not new. The prior art is replete with various types of such signs, designed to be mounted or held on some portion of the vehicle when in use. For example, in U.S. Pat. No. 4,456,126 of Hicks, a box containing warning signs is designed to have its lid open to display the sign with the box itself held in place by a rib extending into the slot created by the junction of the trunk lid and body of the car. The signs themselves are unrolled and made to hang over the lid. Another such device using a mechanical connection to the car is shown in U.S. Pat. No. 3,975,849, where a triangular holding member clips to the window of the vehicle.

U.S. Pat. No. 3,772,811 of Alsup discloses a box containing a frame member for holding the sign, wherein the box is mounted on the car by magnetic means. The frame that holds the sign consists of metallic rod members which must be assembled to create a platform for the sign. On the other hand, U.S. Pat. No. 3,670,438 of Carroll et al discloses a sign which is simply a triangular plate held in place on the vehicle body by a magnet. In order that the sign be visible to approaching motorists, the plate must be placed on a vertical or steeply sloping portion of the car body, which places the sign too low to be easily seen.

While it is desirable to have the sign as high as possible for maximum visibility, mounting the sign on the roof of the car with magnets, as is shown in U.S. Pat. No. 3,797,151 of Dexter, means that it will be subjected to winds and the drafts created by passing vehicles, causing it to be unstable and subject to being blown over. Dexter attempts to obviate this through the use of a long magnetic member fitted into a groove on the bottom surface of a base member. The sign comprises a board fitted into a slot in the base member. Such an arrangement only partially solves the problem since the sign board is mounted on the base in such a way that it increases the wind resistance of the assembly, thus partly offsetting the advantage of the overly large magnet.

It is, therefore, an object of the invention to provide a distresss sign assembly that can be mounted on top of a vehicle and yet is capable of withstanding the winds and drafts commonly encountered.

It is another object of the invention to provide a distress sign assembly that can be easily assembled and disassembled into a flat, compact package for easy stowage and transport.

It is still another object of the invention to provide a distress sign assembly that is capable of displaying messages whose length is not limited by the structure of sign holding portion of the assembly.

Another object of the invention is to provide a distress sign assembly that does not require large magnets for firm and stable mounting of the assembly on the roof of a vehicle.

SUMMARY OF THE INVENTION

The objects of the invention are realized in a first illustrative embodiment thereof which comprises a substantially flat, thin base member formed as by molding, of thin semi-flexible plastic material, such as, for example, polypropylene. The base member has formed, on outside thereof, one or more raised bosses, each having a flat face substantially perpendicular to the plane of the base. Each of the flat faces is covered by Velcro® material affixed thereto. The other side of the base member has affixed thereto, preferably at each end, one or more strips of magnetic tape.

The sign comprises a thin substantially flat member, preferably of the same material as the base, having embossed letters thereon which spell out the desired message. For maximum visibility, the letters are painted with reflecting paint or ink, or with luminous or fluorescent material. On the side of the sign opposite the letters are affixed strips of Velcro® material spaced to match the spacing of the bosses on the base. Thus the sign is easily assembled by simply pressing the Velcro® strips on the sign into engagement with the Velcro® strips on the boss or bosses on the base. Because the assembly is extremely light and the plastic is semi-flexible, any wind or drafts will act to push the Velcro® strips into firmer engagement, and, in extremes of wind, the resiliency of both the strips and the plastic of the sign will allow the plastic sign to give or bend without disengaging from the base. Because the sign assembly is quite light, large maagnets are not required to hold the assembly in place.

In another illustrative embodiment of the invention, the bosses on the base have two flat faces covered with Velcro®, and signs are affixed to both faces, so that traffic in either direction can observe the distress message.

BRIEF DESCRIPTION OF THE DRAWINGS

FIG. 1 is a front elevation view of the distress sign assembly as assembled for use;

FIG. 2 is a side elevation view of the assembly of FIG. 1;

FIG. 3 is an elevation view of the base unit;

FIG. 4 is a plan view of the under side of the base unit;

FIG. 5 is a side elevation view of a second embodiment of the distress sign assembly; and, FIG. 6 is a side view of the disassembled distress sign assembly as stacked for storing.

DETAILED DESCRIPTION

The distress sign assembly 11 as shown in FIG. 1 comprises a sign plate 12 and a base or supporting plate 13. Sign plate 12 is preferably thin, semi-flexible plastic material, such as polypropylene, and has embossed thereon the desired distress message. By "semi-flexible" is meant that the material is sufficiently stiff to hold its form and shape, but flexible enough to bend readily under stress. While "Out of Gas" is shown as the message, it is to be understood that a number of such plates, each having a different message, may be included as part of the assembly kit. The embossed letters 15 which may be formed during the molding of plate 12, are covered with paint or ink 14 which may, for greater visibility, be of fluorescent or luminescent material.

Base member 13 is preferably molded of the same material as plate 12, and has protruding from one surface 16 thereof a plurality of bosses 17. While a plurality of bosses 17 have been shown, a single long boss or a pair of bosses may be used, as will be apparent hereinafter. As best seen in FIG. 2, each of the bosses has a relatively flat faces 18 which is substantially perpendicular to the plane of base 13. "Substantially perpendicular" as used herein does not mean strict verticality, but is intended to include a somewhat sloping face, as can be seen in FIG. 5 for example. The face 18 of each boss or protrusion is covered with Velcro® material 19 which may be cemented or otherwise firmly affixed to the face 18.

The reverse or back side of sign plate 12 likewise has affixed thereto Velcro® strips 21 shown in dotted outline in FIG. 1, the spacings of which match the spacings of the faces 18 on the base 13. To assemble the distress sign assembly, it is only necessary to choose the proper message and then to press the message plate 12 against the faces 18 of protrusions 17 so that the Velcro® strips on plate 12 mesh with the Velcro® strips on the faces 18, as best seen in FIG. 2. Velcro® is a commercial name for a plastic hook and loop fastener. The material is somewhat soft and yielding, and yet, when meshed with a matching piece, forms a very strong bond.

It is preferable that the height of the sign plate be considerably greater than the height of the boss or bosses, thereby allowing some movement of the sign plate in windy conditions.

FIG. 4 depicts the underside of the base 13 which has affixed thereto magnet members 22 and 23. Members 22 and 23 are preferably formed of flexible magnetic tape. Such tape, which is readily available commercially, has a rubber-like consistency and is unlikely to mar the finish of the vehicle surface upon which the assembly is mounted. Members 22 and 23 may be affixed to base 13 as by cementing or other suitable means, While only two magnetic members have been shown, added adherence to the vehicle surface may be had by an increase in the number or size of the magnetic strips, although in normal usage, two such strips will suffice. As can be appreciated from FIGS. 1 and 2, the greatest wind resistance of the assembly will be to winds substantially normal to the longitudinal axis of the base. Resistance to any tendency of the assembly to tip over in such winds is increased by placing magnetic strips 22 and 23 across and normal to the longitudinal axis of the base. Further resistance to such tendency to tip over can be had by offsetting protrusions 17 slightly from the longitudinal centerline of base 13, as best seen in FIG. 2, so that the plate 12 is positioned substantially above the centerline.

When the distress sign is assembled and placed, for example, on the roof of an automobile, the flexibility of the material of base 13 permits it to conform to the vehicle surface, thus insuring firm adherence by magnets 22 and 23. By the same token, the flexibility of the material of plate 12 and the resiliency of the Velcro® fasteners permit the plate 12 to yield to the force of the wind without separation from the base, while the base itself remains firmly fixed in place.

In FIG. 5 there is shown a second embodiment of the invention wherein the sign assembly is adapted to display a message in both directions of traffic movement. It can be seen that the boss or protrusion 17 is centered on the base 13, and has two substantially perpendicular, slightly sloping faces 18 and 26. Face 16 is, like face 18, covered with a fastening material 27, such as Velcro®, which mates with a strip 28 of such material mounted on the back of a second sign plate 24. The slight slope of the faces 18 and 26 assists in resisting winds and drafts.

FIG. 6 depicts how the disassembled distress sign assembly can be placed in a compact bundle for stowing and transporting. For simplicity, only the base 13 and sign plates 12 and 24 have been shown, but it can be appreciated that a large number of sign plates can be stacked as shown in FIG. 6. When the various elements are stacked as shown in FIG. 6, the bundle thus formed may be slipped into an envelope or pouch, or simply held together with rubber bands, and stored in a suitable place within the vehicle.

In the foregoing detailed description, the sign plate has been shown as being approximately the same length as the base plate. However, there is no physical restriction on the length of the sign plate, hence, where a long message is to be displayed, such as "SEND AMBULANCE", the sign plate may be of sufficient length to accommodate such a message, regardless of the length of the base plate. This is in contrast to much of the prior art, where the size of the sign is limited by the size of the sign holding member or base.

I claim:

1. A sign assembly for detachably mounting on a vehicle body comprising:

a substantailly flat, semi-flexible base member having a plurality of protrusions extending from one surface thereof, each of said protrusions having a flat face oriented substantially perpendicularly to said one surface, first connecting means comprising a hook and loop material strip mounted on the flat face of each of said protrusions, a substantially flat, semi-flexible sign plate having letters forming a message extending from one surface thereof, said letters being covered with a visibility enhancing material, the height of said sign plate being greater than the height of said protrusions, second connecting means adapted to mate with said first connecting means mounted on the surface of said sign plate opposite the surface thereof containing said letters, and a plurality of magnetic members affixed to the surface of said base member opposite the surface from which said protrusions extend, said magnetic members extending transversely of the longitudinal axis of said base member.

2. A sign assembly as claimed in claim 1 wherein said protrusions are laterally offset from the longitudinal center line of said base member.

3. A sign assembly as claimed in claim 1 wherein each of said protrusions has a second flat face opposite said flat face, and third connecting means comprising a hook and loop material strip mounted on said second flat face.

4. A sign assembly as claimed in claim 3 and further including a second substantially flat, semi-flexible sign plate having letters forming a message extending from one surface thereof, and fourth connecting means adapted to mate with said third connecting means mounted on the surface of said second sign plate opposite the surface thereof containing said letters.

5. A sign assembly as claimed in claim 3 wherein said protrusions are located along the longitudinal center line of said base member.

6. A sign assembly for detachably mounting on a vehicle body comprising:

a substantially flat base member having a protrusion extending from the plane of said base member, said protrusion having a flat face thereon oriented substantially perpendicularly to the place of said base member, first connecting means mounted on said flat face, a substantially flat sign plate having letters forming a message formed on one surface thereof, wherein said base member and said sign plate are formed of a thin semi-flexible plastic material, second connecting means adapted to connect with said first connecting means mounted on the reverse surface of said sign plate, and means for mounting and holding said base member on a vehicle surface, said mounting and holding means being mounted on said base member on the surface opposite the surface from which said protrusions extend.

* * * * *